US005859574A

United States Patent [19]

Schmitt

[11] Patent Number: 5,859,574

[45] Date of Patent: Jan. 12, 1999

[54] DIELECTRIC RESONATOR, AND MICROWAVE FILTER PROVIDED THEREWITH

[75] Inventor: Dietmar Schmitt, Kleinaspach, Germany

[73] Assignee: Robert Bosch GmbH, Stuttgart, Germany

[21] Appl. No.: 726,824

[22] Filed: Oct. 8, 1996

[30] Foreign Application Priority Data

Oct. 9, 1995 [DE] Germany ..... 195 37 477.0

[51] Int. Cl.[6] ..... H01P 1/20; H01P 7/10

[52] U.S. Cl. ..... 333/202; 333/219.1

[58] Field of Search ..... 333/202, 208, 333/212, 219, 219.1, 235, 21, 228

[56] References Cited

U.S. PATENT DOCUMENTS

| | | | |
|---|---|---|---|
| 4,423,397 | 12/1983 | Nishikawa et al. | 333/212 X |
| 4,881,051 | 11/1989 | Tang et al. | 333/219.1 X |
| 5,200,721 | 4/1993 | Mansour | 333/219.1 X |
| 5,233,319 | 8/1993 | Mizan et al. | 333/219.1 |
| 5,325,077 | 6/1994 | Ishikawa et al. | 333/219.1 |
| 5,638,037 | 6/1997 | Kurisu et al. | 333/202 |

FOREIGN PATENT DOCUMENTS

| | | | |
|---|---|---|---|
| 1058014 | 11/1983 | U.S.S.R. | 333/202 |
| 2276039 | 9/1994 | United Kingdom . | |

OTHER PUBLICATIONS

Wakino et al., "Miniaturization Techologies . . . for Mobil Communications", IEEE Trans on Microwave Theory & Tech. vol. 42, No. 7, July 1994, pp. 1295–1300.

*Primary Examiner*—Seungsook Ham
*Attorney, Agent, or Firm*—Michael J. Striker

[57] ABSTRACT

In a dielectric resonator a dielectric insert is formed so that at least two slots are provided, which are located opposite to one another and extend symmetrically and radially toward a center. Because of the radial slots, a dielectric resonator with high mode distance and high quality is obtained.

25 Claims, 24 Drawing Sheets

E1

E4

E5

B5

E6

B6

E1

B1

B1

E2

E2

B2

B2

DIELECTRIC RESONATOR, AND MICROWAVE FILTER PROVIDED THEREWITH

BACKGROUND OF THE INVENTION

The present invention relates to a dielectric resonator having at least one dielectric insert arranged in a resonator housing.

Dielectric resonators with different structured dielectric inserts, for example ring structures, bars and disks with round or square cross sections, are IEEE disclosed in Transactions on Microwave Theory and Techniques volume 42, number 7, Jul. 19, 1994 and in the British Patent document in GB 2,276,039A. The structures serve for concentration of electromagnetic fields in dominant modes. Because of the relatively high dielectricity number DK, dimensions which are lower by the factors $\sqrt{DK}$ are obtained with the same resonance frequency. The European Patent Document EP 496,592 A1 also discloses a dielectric resonator with one or several short circular cylinders which are connected through superconductive bridges with the inner walls of the resonator housing.

SUMMARY OF THE INVENTION

Accordingly, it is an object of the present invention to provide a dielectric resonator of the above mentioned general type, which is further improvement of the existing dielectric resonators.

In keeping with these objects and with others which will become apparent hereinafter, one feature of the present invention resides, briefly stated, in a dielectric resonator having at least one dielectric insert in a resonator housing with the insert formed so that two opposite slots are provided, which extend radially in direction of the center and symmetrically relative to one another.

Filters can be made from the dielectric resonator in accordance with the present invention. For the size of the filters formed from the dielectric resonators, the presence of dual or triple modes is decisive. If more than one mode osctilates during one frequency, a degeneration takes place. The higher the number of the modes, the more volume-favorable is the filter construction. A further important characteristic size in the design of the resonators is the distance of the utilized mode or modes at one frequency to the lower and higher modes for frequencies at which the other modes are oscillation-susceptible. This distance is important for multi-plexers composed of directly coupled filters.

The dielectric resonator in accordance with the features of the present invention has modes with the same resonance frequency (degeneration), wherein a sufficiently high modes distance can be obtained by the slot. Since the slot extends far to the center, the base mode is suppressed, which as a rule in cylindrical structures is a signal mode, depending on the thickness of the dielectric in a central region, and is utilized in standard filters in accordance with the prior art. Simultaneously, with the dielectric resonator in accordance with the present invention, at least a dial mode is formed, whose energy is located in the central region of the dielectric insert.

The inventive structure of the insert can be formed as a one-piece structure or as an assembly of geometric standard elements, for example disk-shaped triangles, such as trapezes, circular segments, etc. They are arranged relative to one another so that at least two oppositely located slots extending in direction toward the center radially and symmetrical relative to one another are produced. When a predetermined thickness, in particular in the central region is provided, a triple mode or higher modes are utilized. A further advantage of the slotted structure is provided in the possibility of adjustment of the mode distance in certain limits, by a corresponding selection of the width or the cross-sectional area of the slot and its length. A coupling of both (dual modes) correspondingly higher modes in some cases, can be also performed in the slots substantially through determination elements, for example in form of bars or differently wide cuts formed for example as stepped slots.

For holding the dielectric insert in the resonator housing, conventional elements can be used. For example, ceramic supporting bodies, pressing screws, spring elements and others can be utilized, as well as the elements disclosed in the older German patent application DE 1 95 24 633.0.

The inventive dielectric resonator therefore can be used as a resonator with double, triple or higher modes of high quality, with relatively great mode distance, in particular with high power. Because of the good alignment and coupling possibilities, the dielectric resonator in accordance with the present invention is suitable for production of microwave filters.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
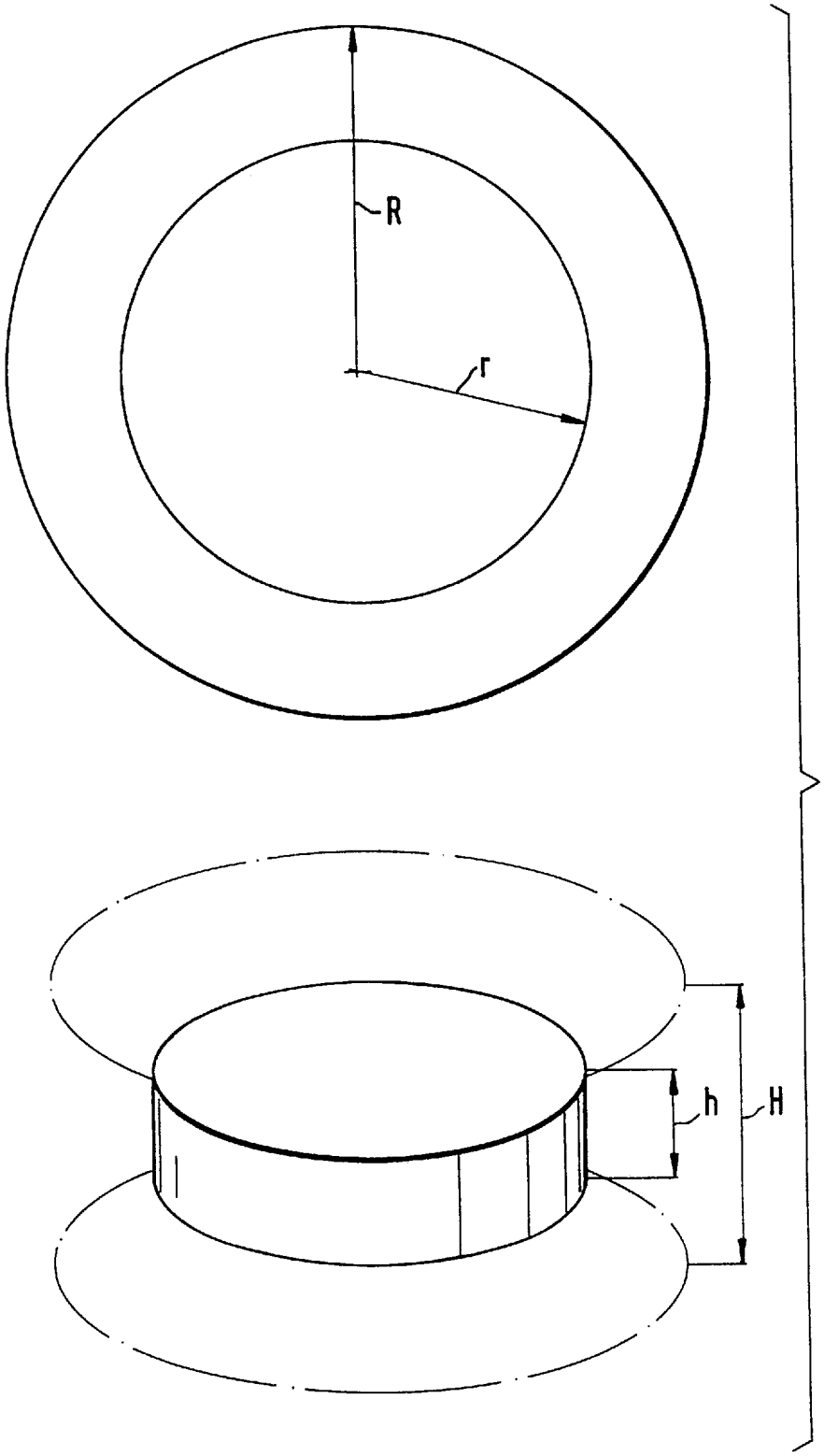
Fig.1 PRIOR ART
FIG. 1 is a view showing a shape of a conventional insert for a dielectric resonator.

FIG. 1 shows a shape of a conventional dielectric insert for a dielectric resonator. The metallic resonator housing is composed of a circular cylinder with an inner diameter R and an inner height H. A dielectric insert in form of a circular cylindrical dielectric ceramic disk is accommodated in the resonator housing and has a diameter r and the height h. A C-band filter must be realized with a medium frequency of 3.7 GHz and with use of dual-mode hollow space resonator. The EH11 δ mode is used as a working mode. The dielectricity constant is $\in$=36. With this assumptions, a maximum distance of the working mode relative to the desired mode can be obtained from the following table:

| Mode Type | Frequency/GHz | Relative Distance to Mode 2/3 |
|---|---|---|
| 1 | 3,062 | 18.1% |
| 2/3 | 3,739 | |
| 4 | 4,626 | 23.7% |

This table is applicable for:

r/R=0,66; h/H=0,33; r/h=1,75

Greater mode distances can not be reached with this resonator type and the selected working mode.

Figure 2:
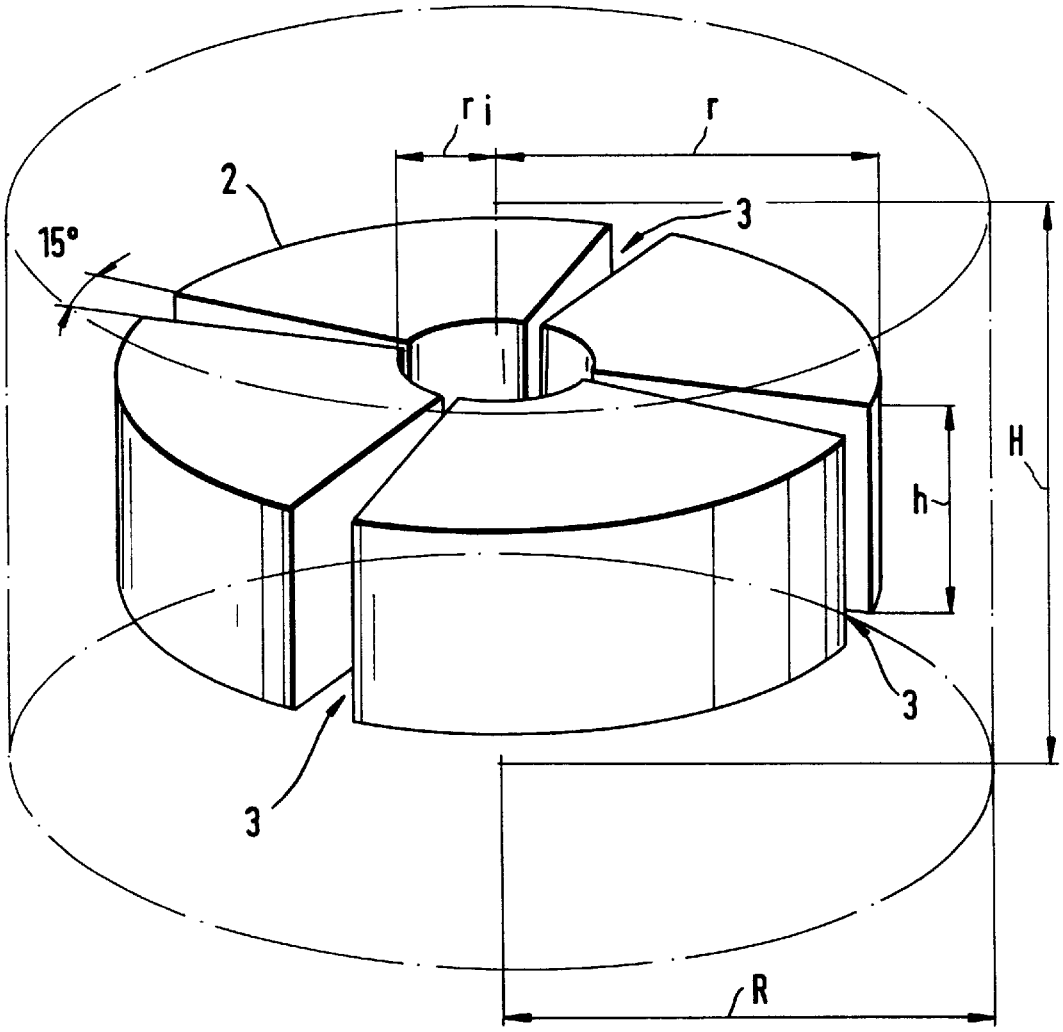
FIG. 2 is a view showing a shape of a dielectric insert for a resonator in accordance with the present invention.

FIG. 2 shows an inventive dielectric resonator with a slot structure. With this resonator a mode distance of 39.5% to the next higher mode can be obtained with the same resonance frequency and the EH11 δ mode as a base mode. FIG. 2 represents only an exemplary embodiment for a greater mode distance. Other structures with even greater mode distances are possible as well.

The dielectric resonator shown in FIG. 2 has a circular-cylindrical resonator housing 1 with a disk shaped circular-cylindrical, one-piece dielectric insert 2. Slots 3 extend from the outer surface of the disk and are arranged in pairs opposite to one another. They extend radially in direction toward the center. The four slots 3 have a substantially identical cross-section. As can be seen from the drawings, they are formed as a pyramid frustum and narrow at an angle of 15° in direction toward the disk center. The central planes of the slots 3 extend perpendicular to the cover surfaces of the resonator housing or the cover surfaces of the circular-cylindrical insert 2. With the dimensions R/r=1.2; h/r=0.5428; H/h=4.5; $r_i$/r=0.28; ∈=30; r=11.2 mm, wherein R is an inner radius of the resonator housing 1, r is a radius of the circular-cylindrical insert 2, H is an inner height of the resonator housing, h is a height of the circular-cylindrical insert 2, and $r_i$ is a radius of the slot bottom, the following table for the lowest mode types is true:

| Mode Type | Frequency/GHz | Relative Distance to Mode 1/2 |
|---|---|---|
| 1/2 | 3.72 | |
| 2 | 5.19 | 39.5% |

The slots 3 are arranged in accordance with the present invention so that they intersect the electrical field lines of the TE01 mode.

The embodiment of FIG. 2 has several advantages with respect to the preferred direction of the dual modes, which can be used in microwave filter structures (simple cascading of several inventive dielectric resonators).

Figure 3:
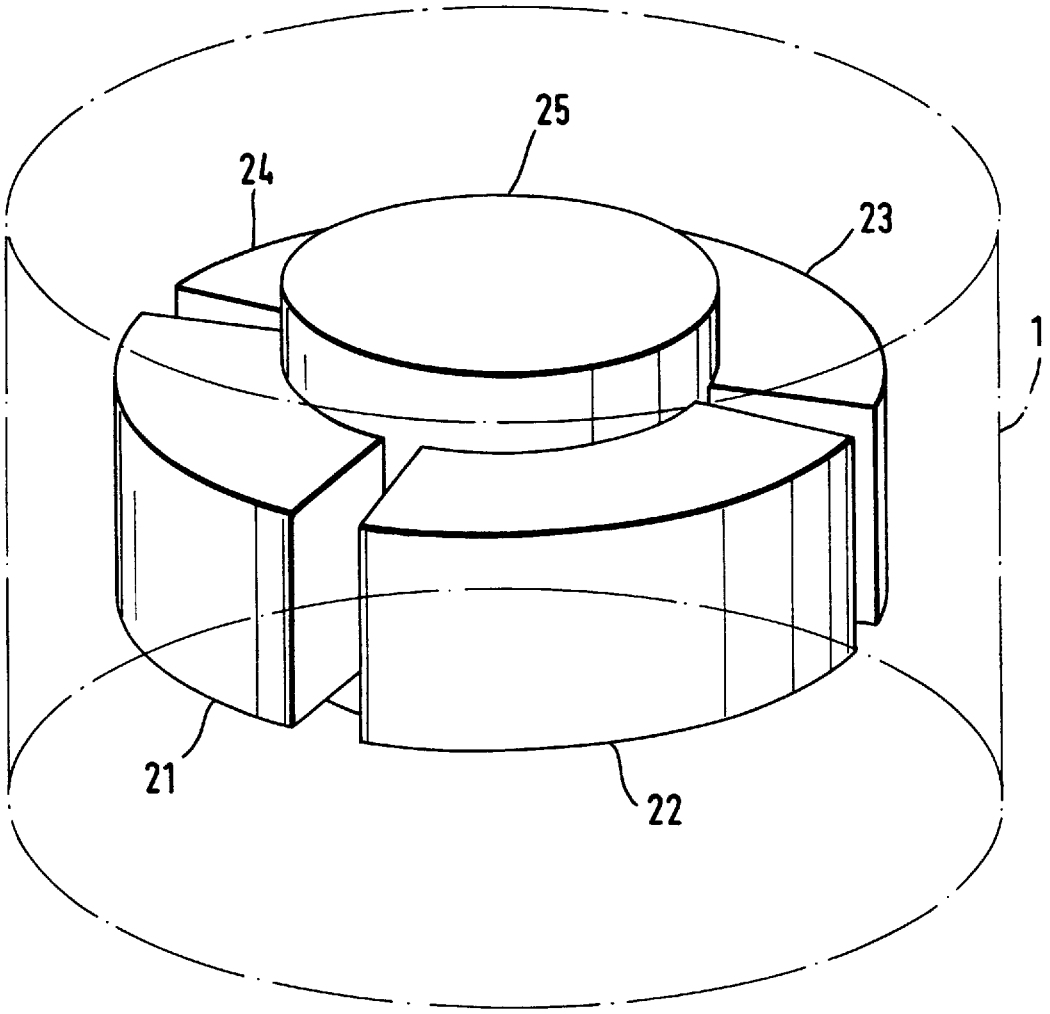
FIG. 3 is a view showing an embodiment particularly for high modes.
Figure 4:
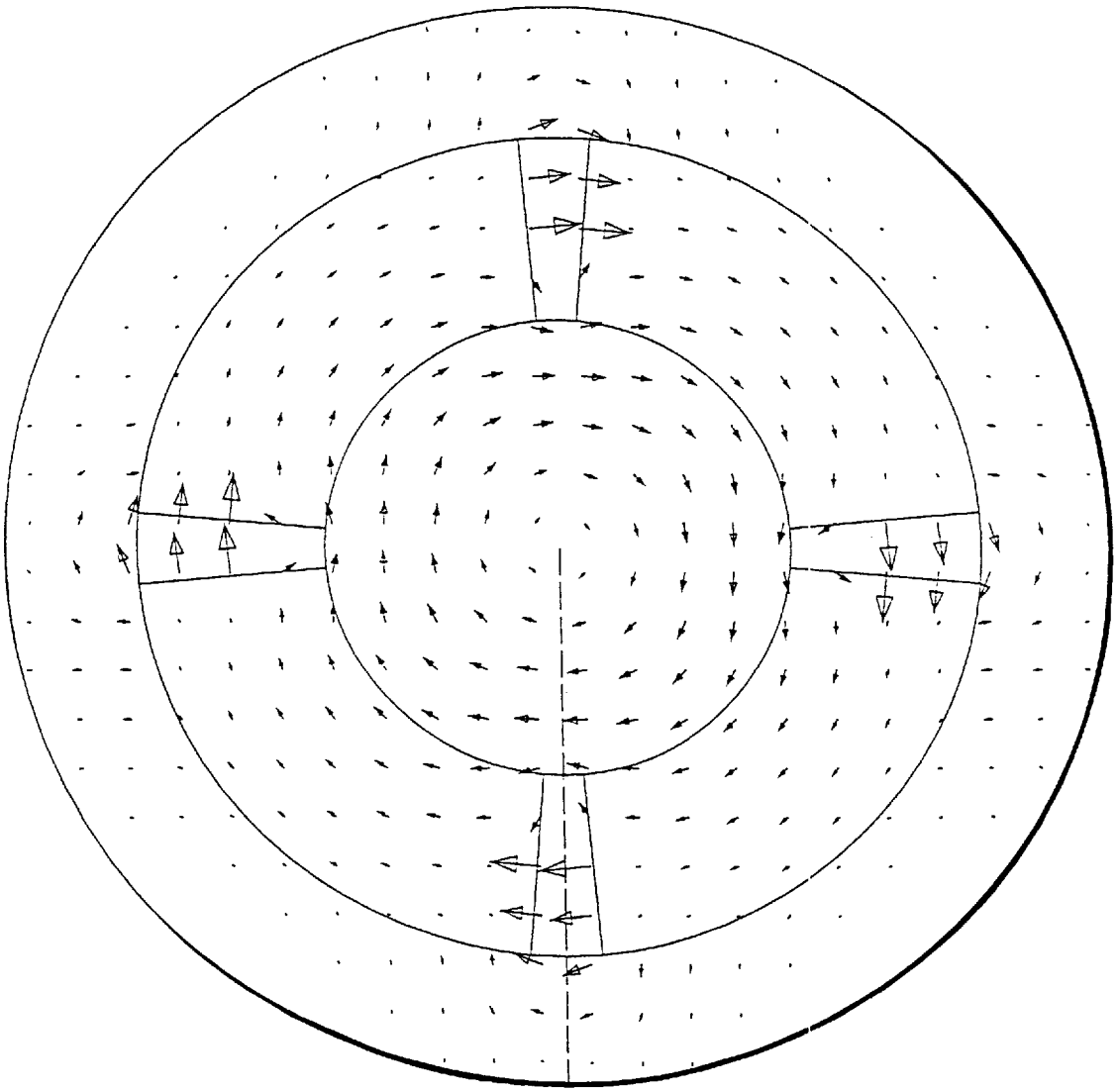
FIGS. 4–15 are views shows field lines formation for the embodiment of FIG. 3.
Figure 5:
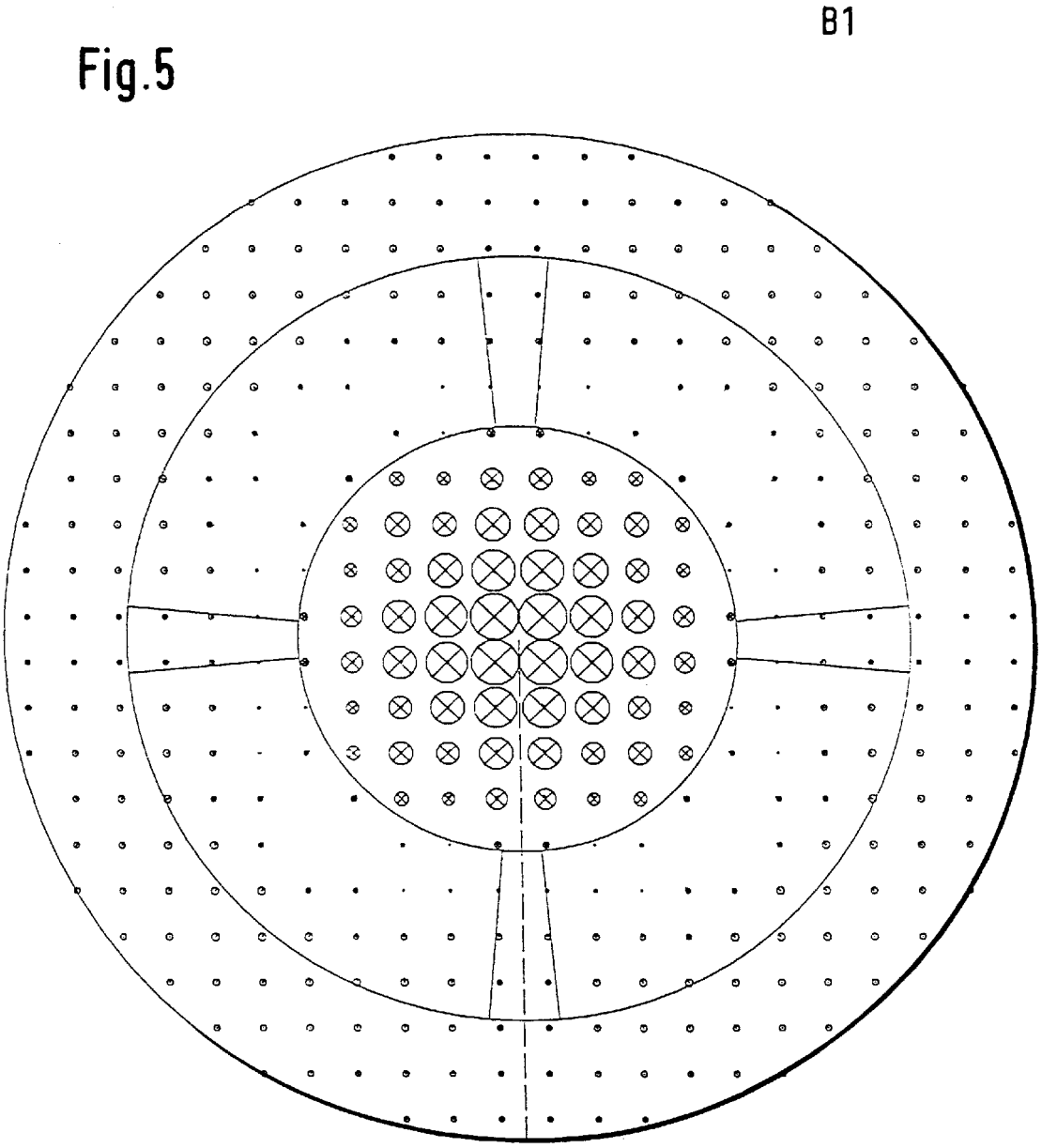
Figure 6:
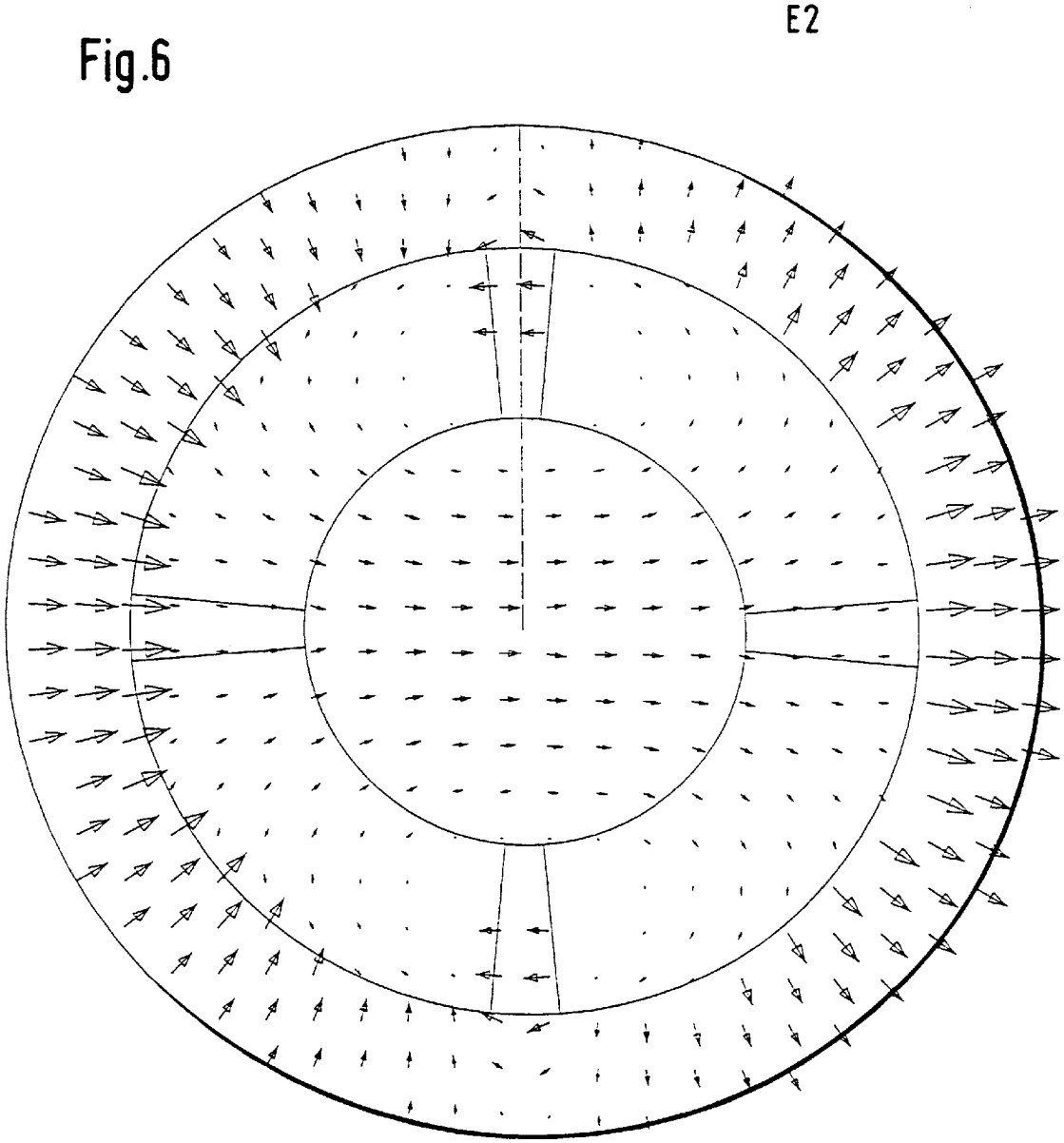
Figure 7:
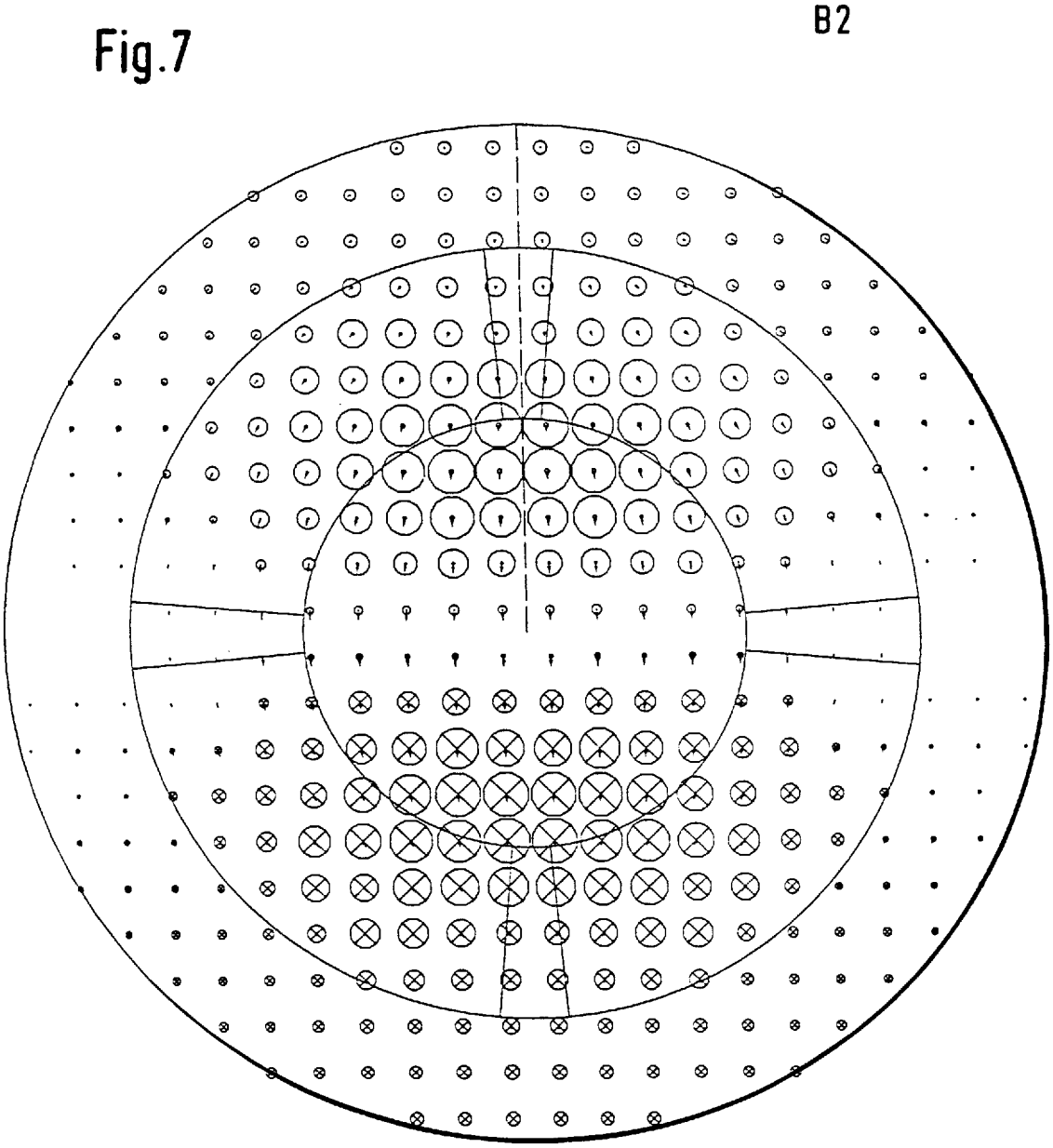
Figure 8:
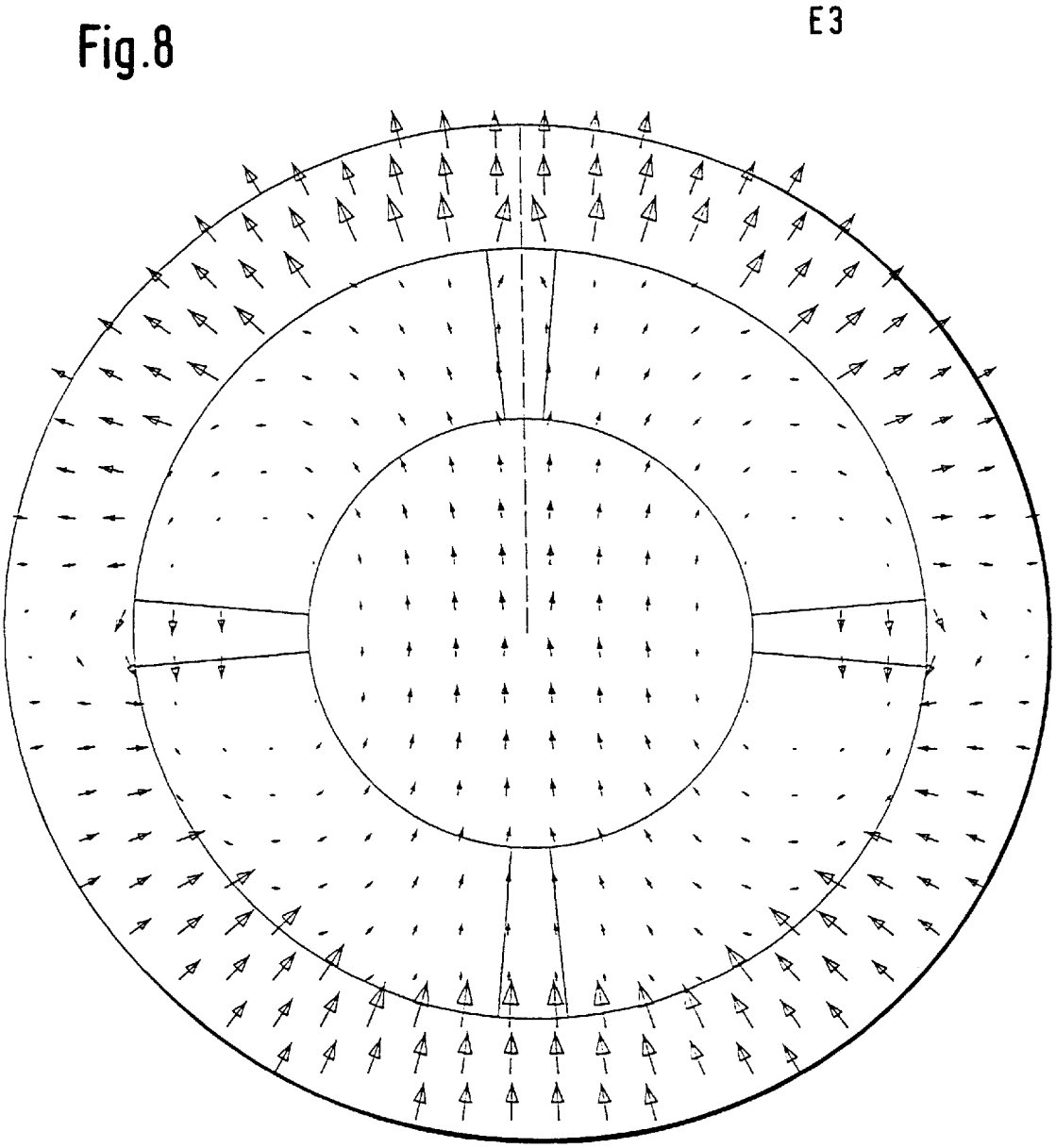
Figure 9:
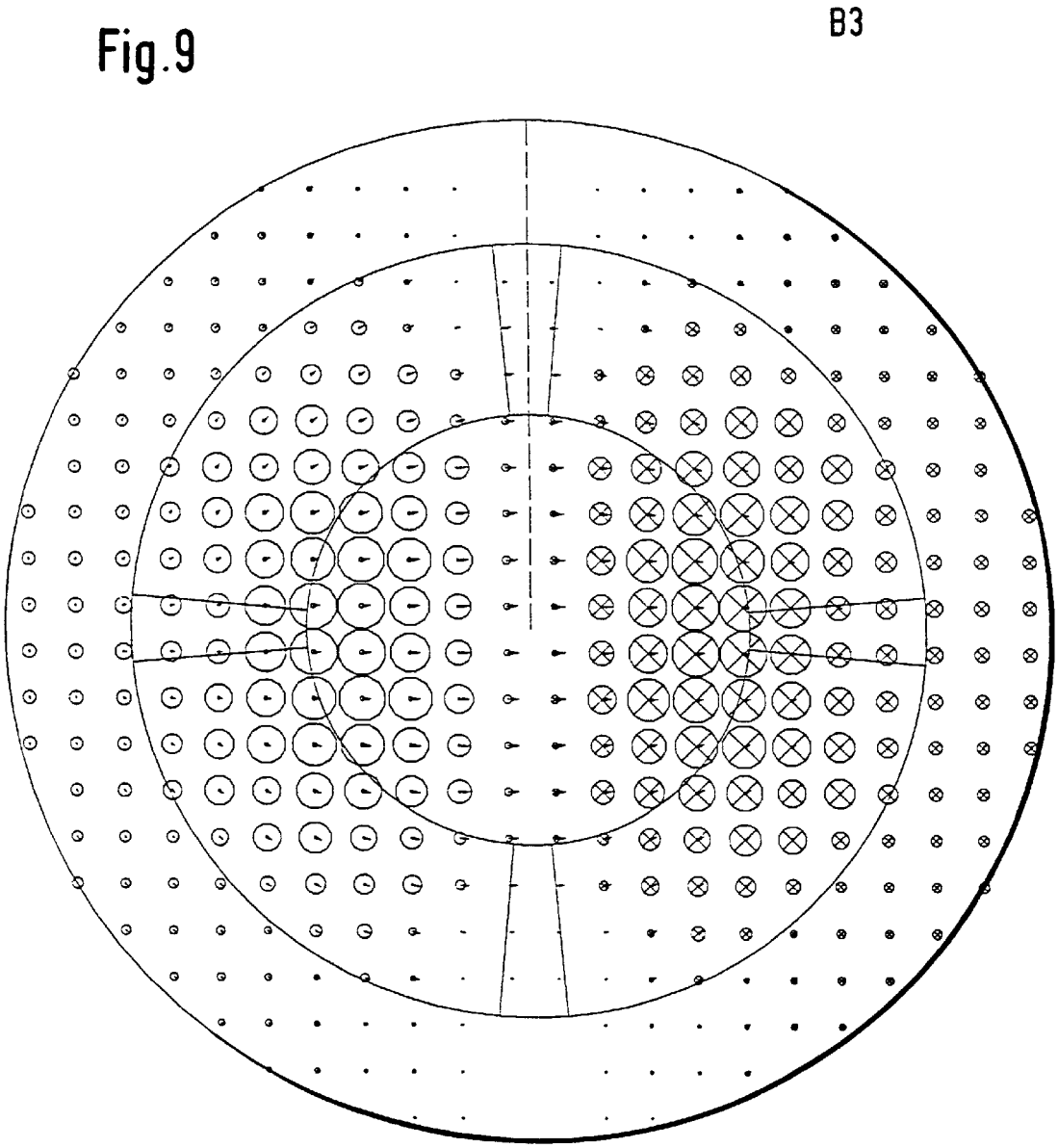
Figure 10:
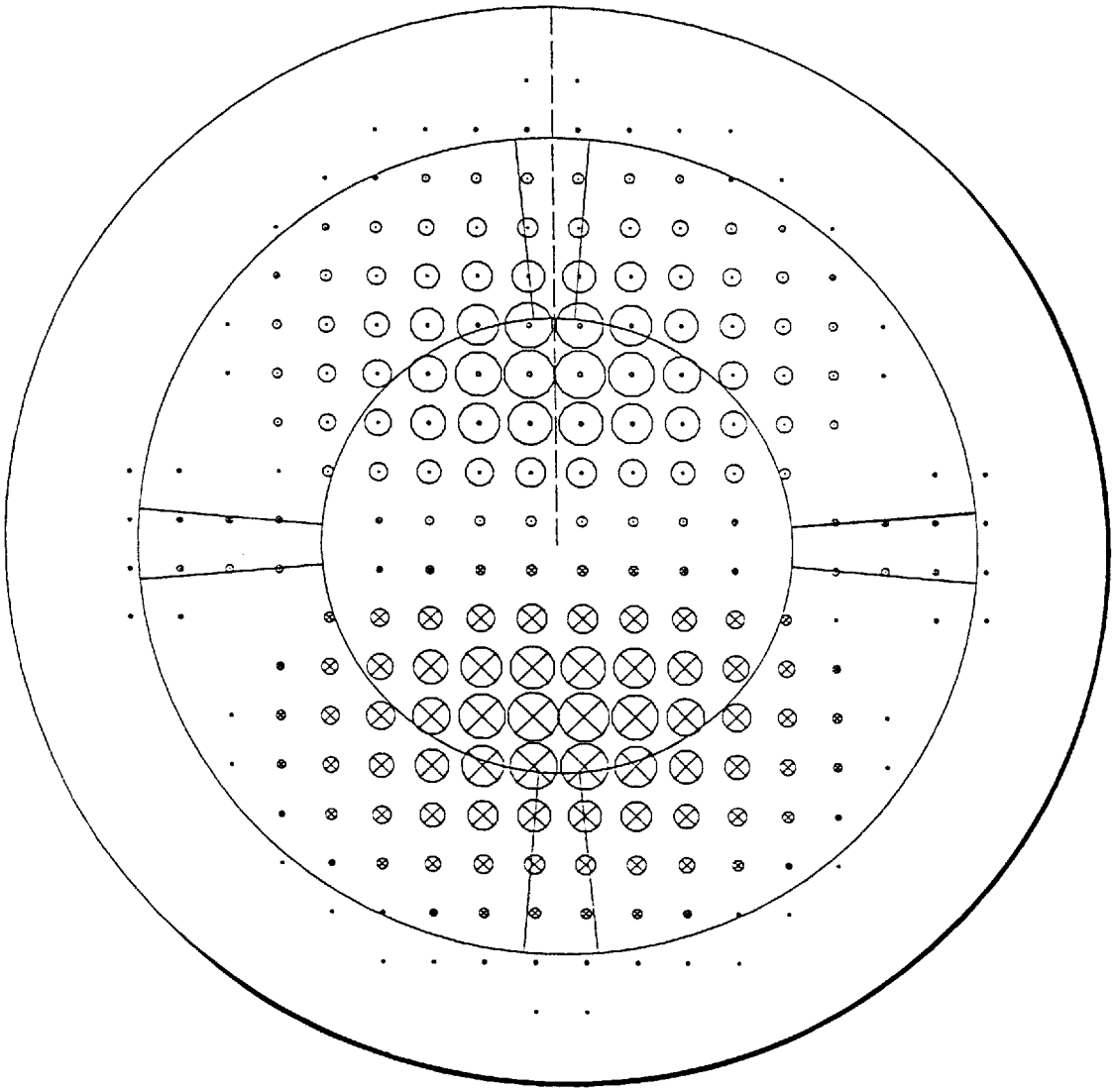
Figure 11:
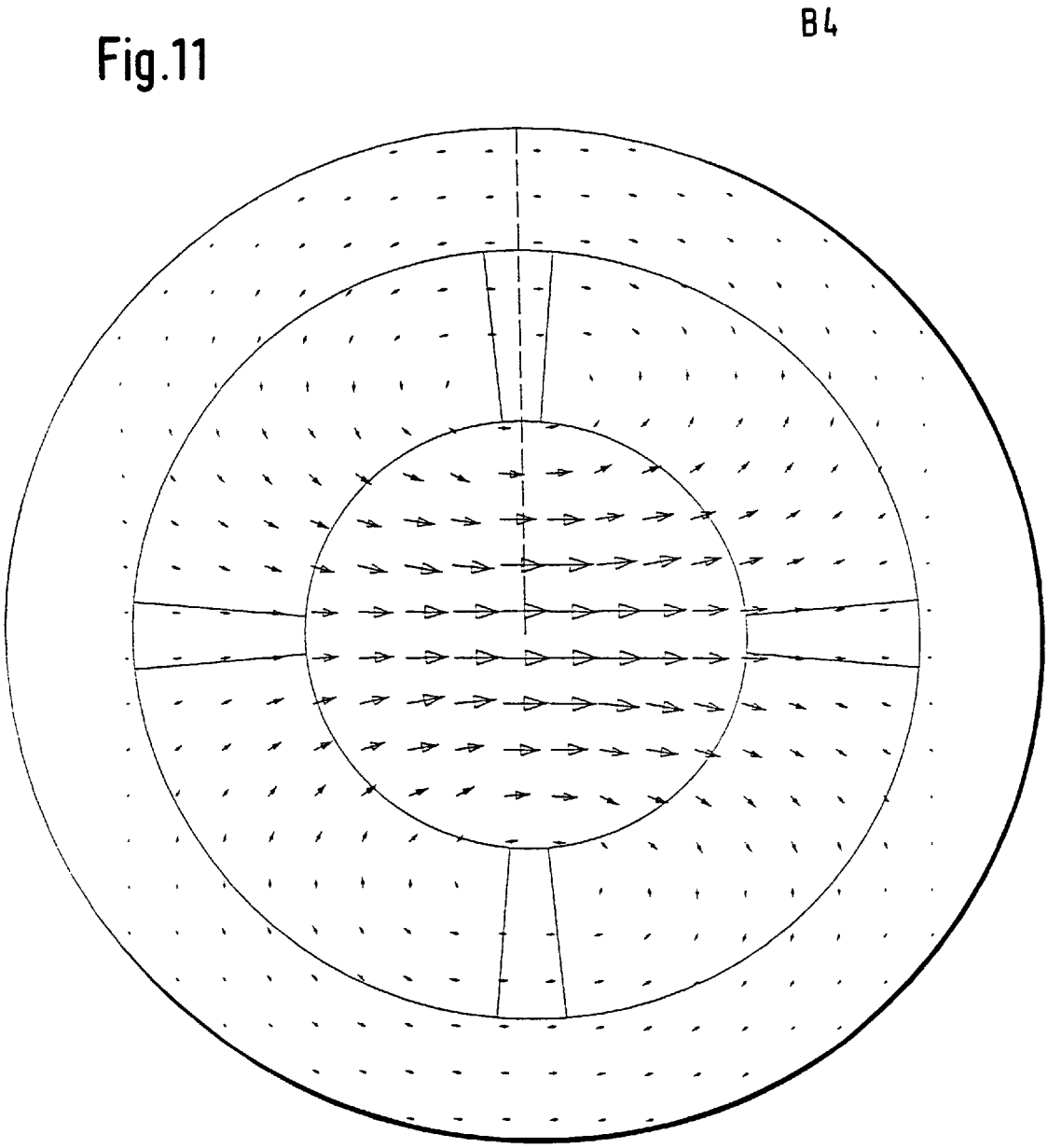
Figure 12:
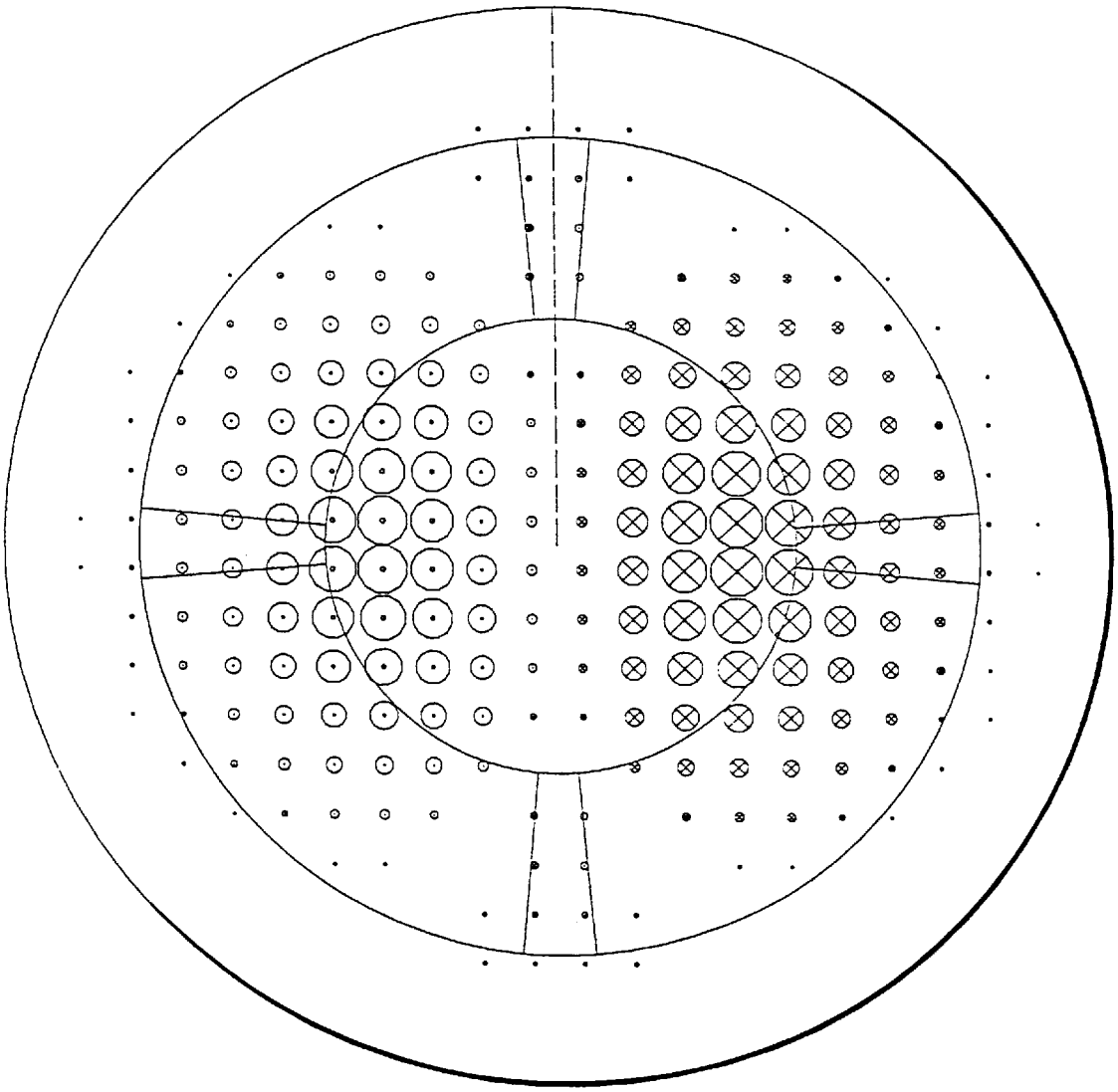
Figure 13:
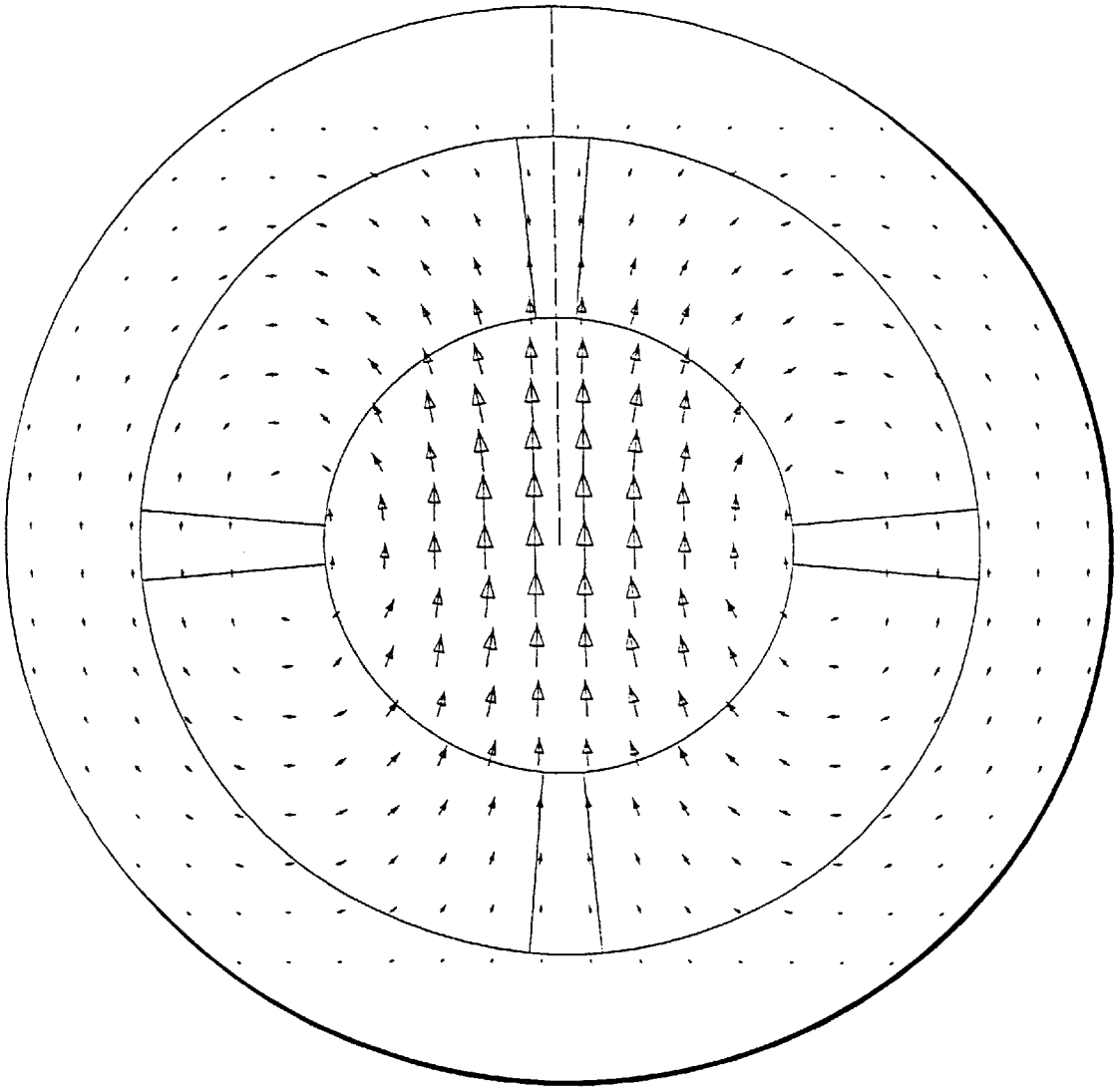
Figure 14:
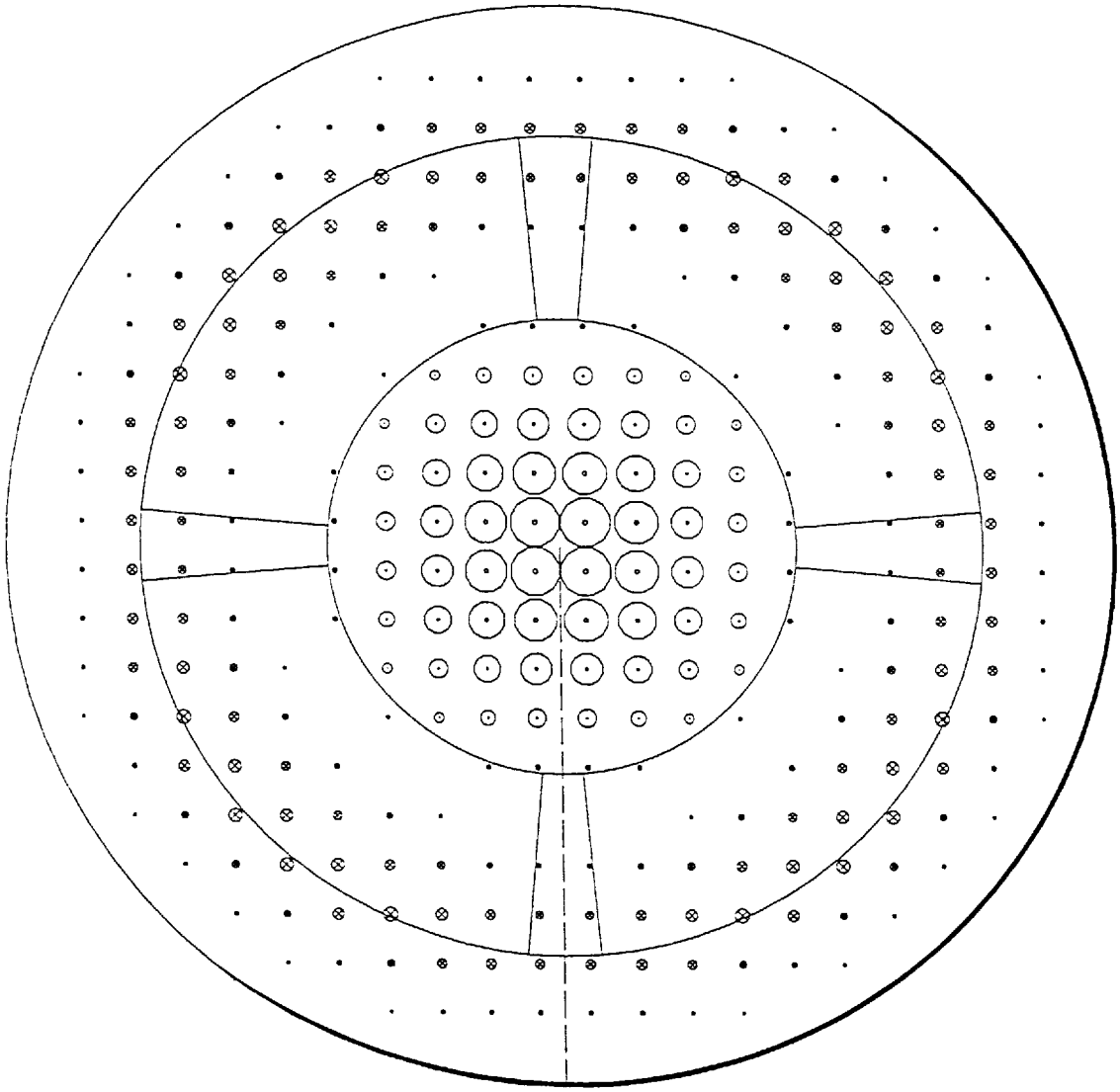
Figure 15:
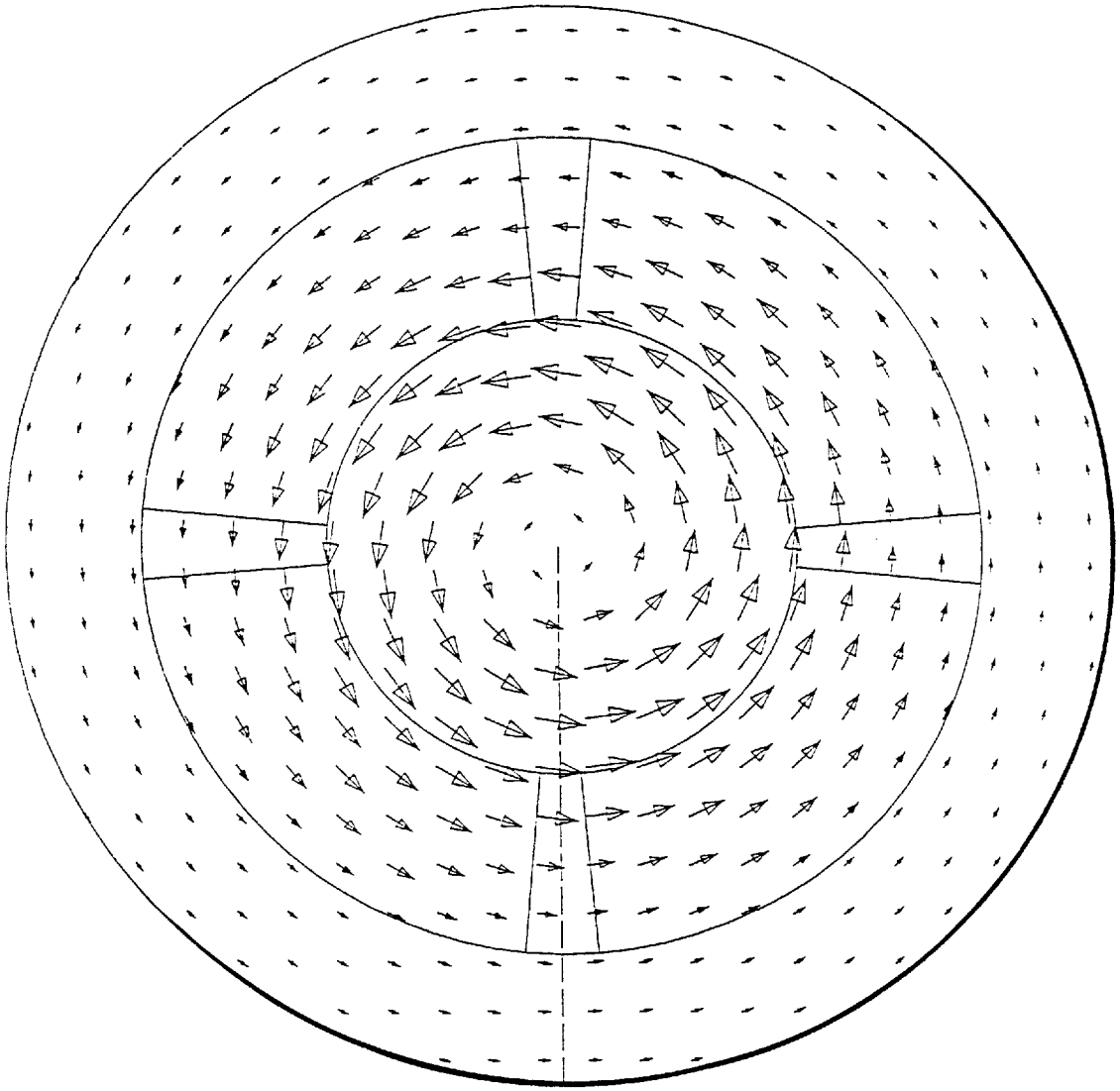

A further embodiment for an inventive dielectric insert is shown in FIG. 3. This insert is composed of a cylinder 25 located in a central region, and circular-ring-shaped segments 21, 22, 23 and 24 arranged on it. The segments 21–24 are arranged relative to one another so that each two adjacent segments form by opposite segment surfaces the slots 3 arranged in pairs relative to one another and point-symmetrical radially to the center of the insert. In this embodiment the central region formed by the cylinder 25 of the dielectric insert exceeds the remaining regions formed by the segments 21–24 in its thickness of cylinder height. With this formation, especially high modes are oscillation-susceptible. By selection of the different dielectric constants, for example a higher dielectric constant in the central region and a lower dielectricity constant in the outer regions or segments, the number of the oscillation-susceptible modes and the mode distance can be influenced.

In the embodiment of FIG. 3 the central region is composed of the same material as the segments which surround them (∈=30–38). Moreover, a filling material with a dielectric constant of for example ∈=2–4 is located outside of the dielectric insert or in other words between the resonator housing wall 1 and the dielectric insert 3. As can be seen from the corresponding field line patterns shown in FIGS. 4–15, the highest electrical field components are located in the air-or vacuum-filled slots 3. The energy density of the modes is concentrated in all cases in the dielectric material. This provides a relatively high quality. In the embodiment of FIG. 3, a sextuplet mode is provided. The oscillation-susceptible modes in FIGS. 4–15 are identified with Ex with respect to the electric fields and with Bx with respect to the magnetic fields, wherein x=1–6.

Figure 16:
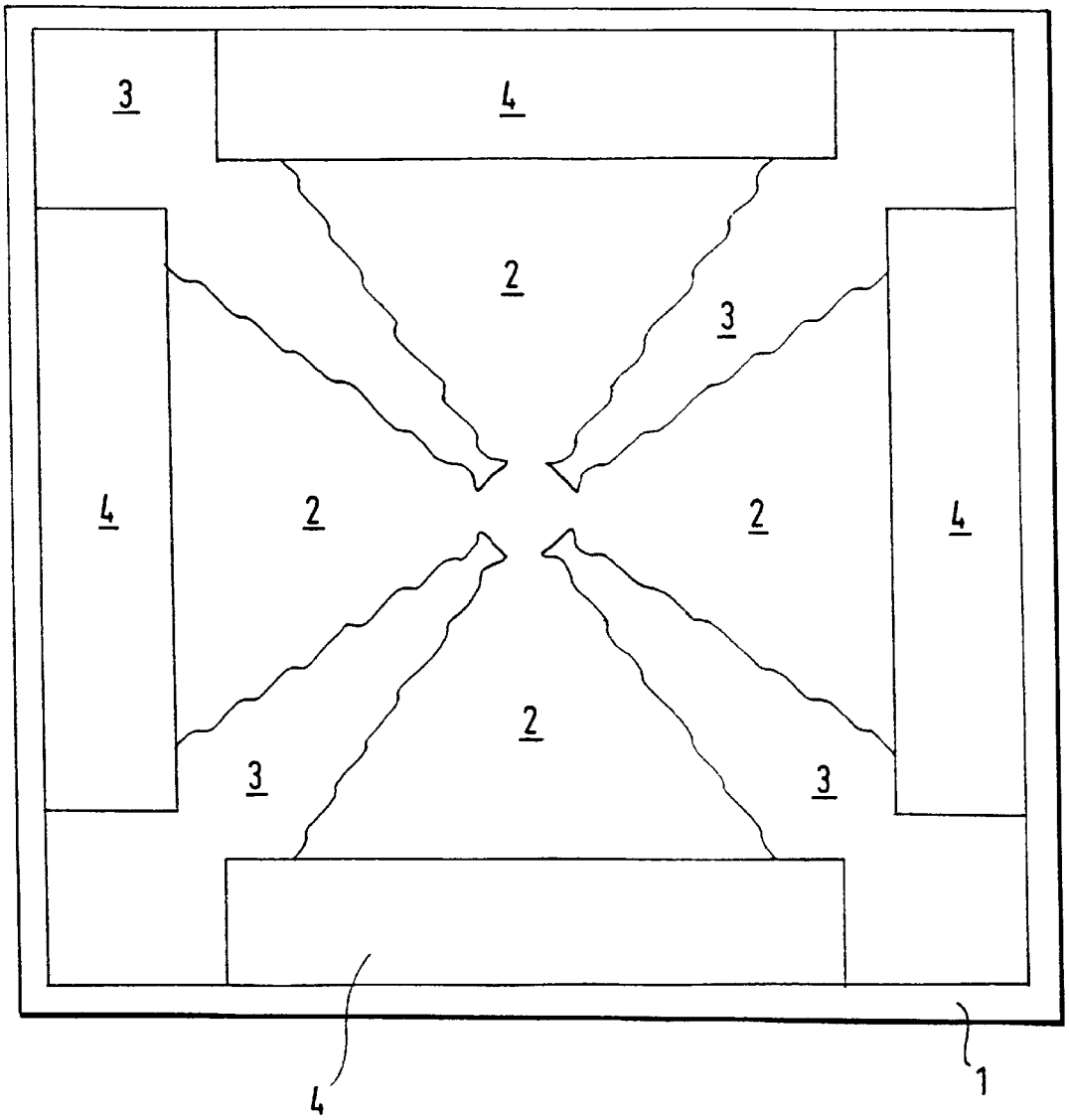
FIG. 16 is a view showing an embodiment of the invention with a rectangular dielectric insert.
Figure 17:
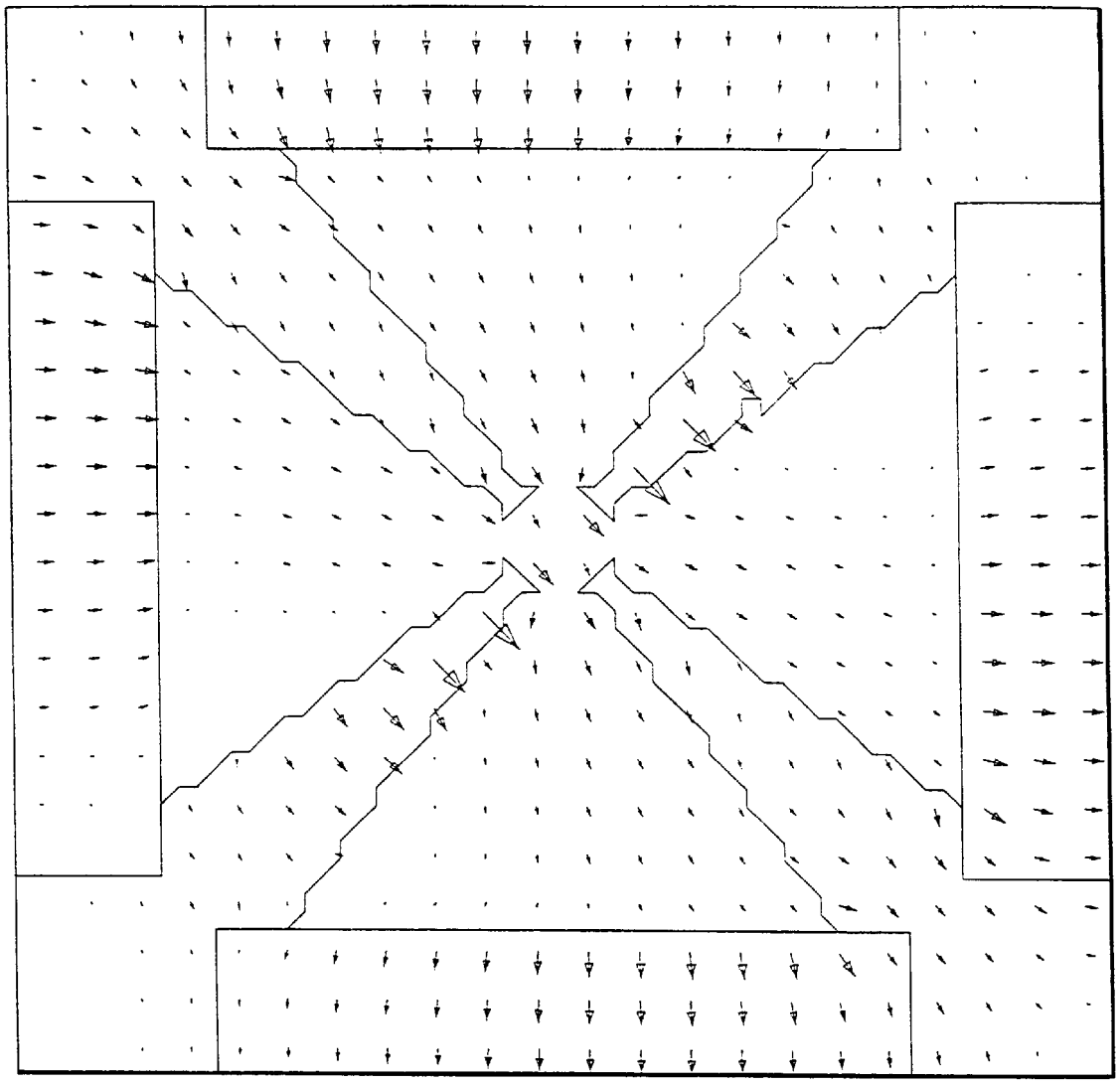
FIGS. 17–24 are views showing field lines formation for the embodiment of FIG. 16.
Figure 18:
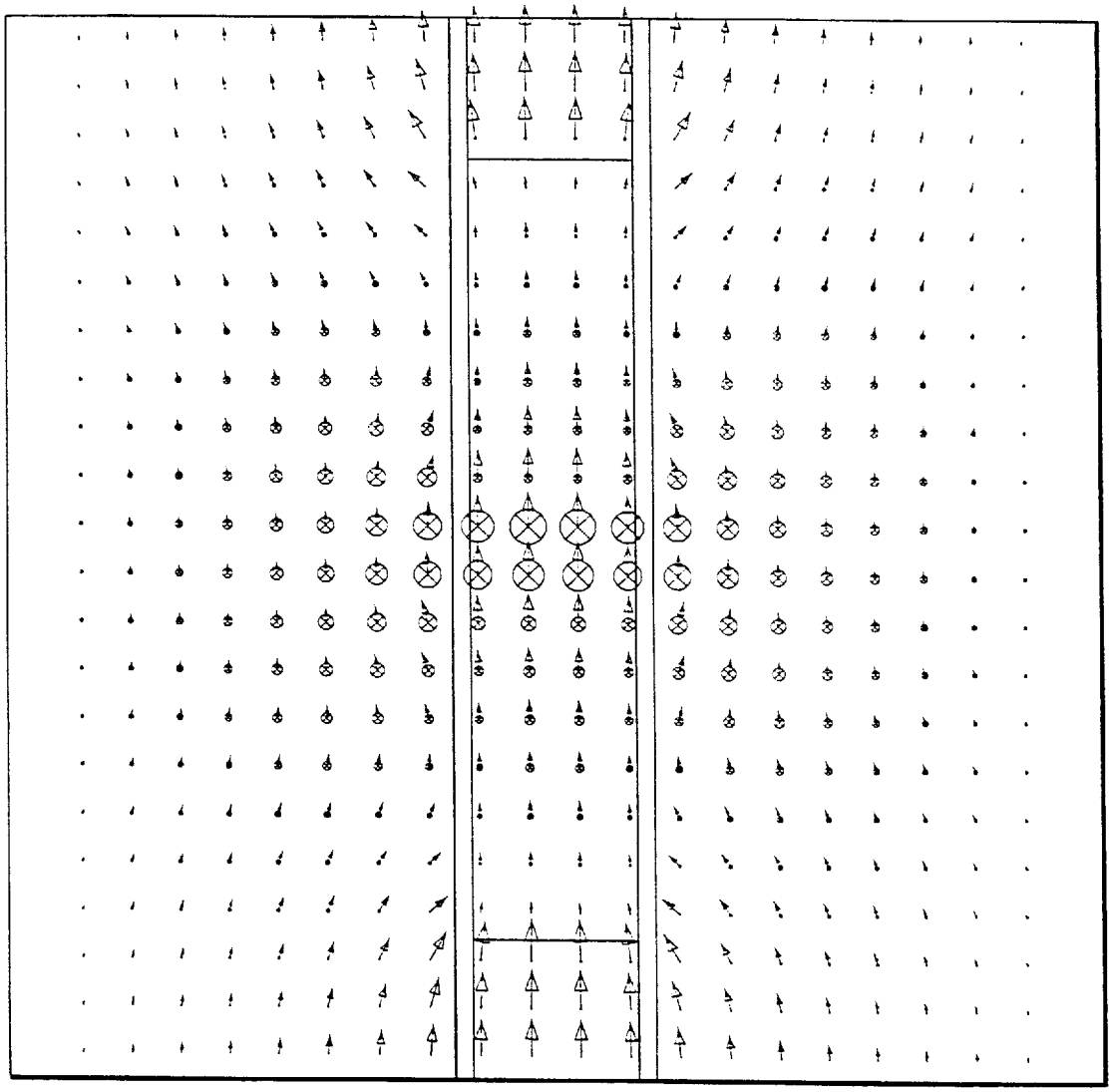
Figure 19:
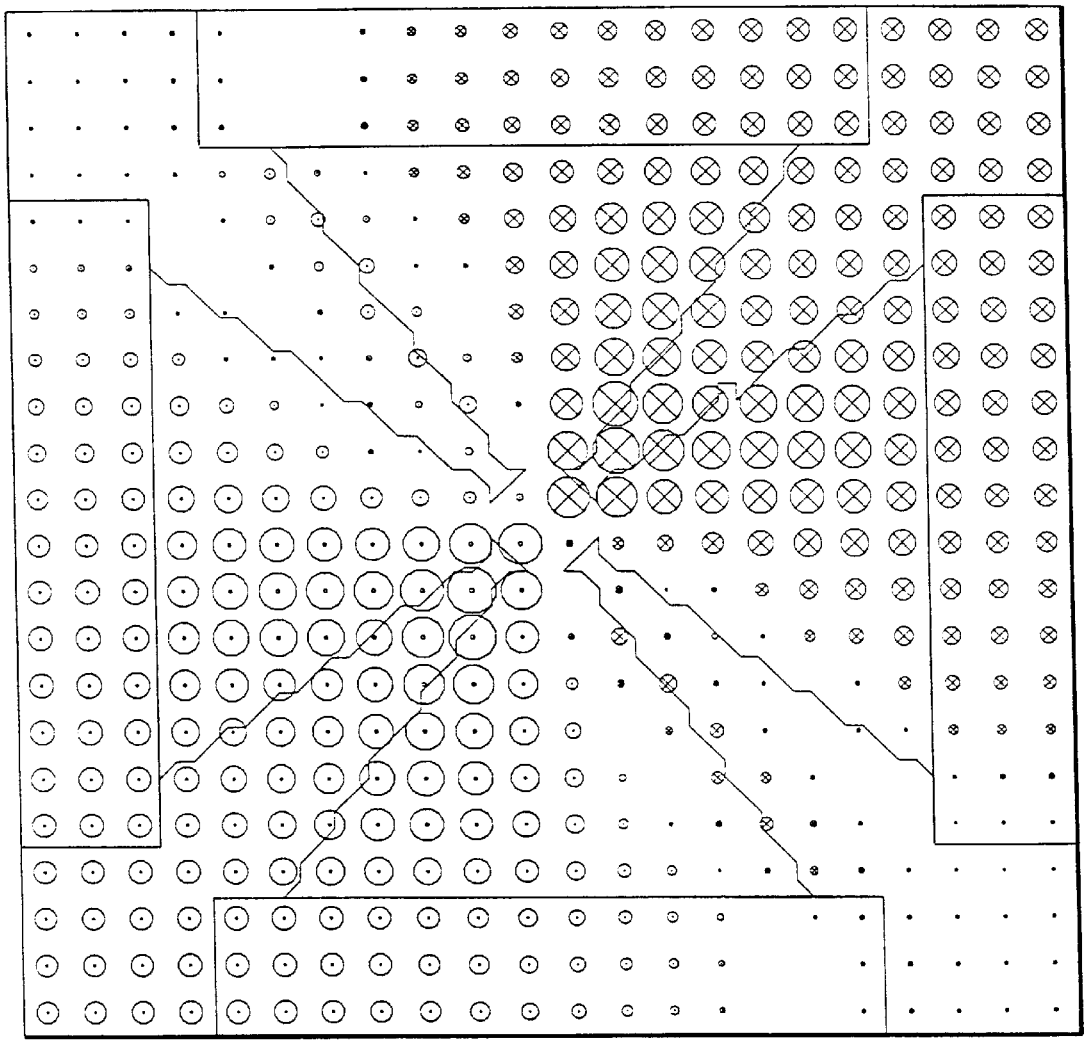
Figure 20:
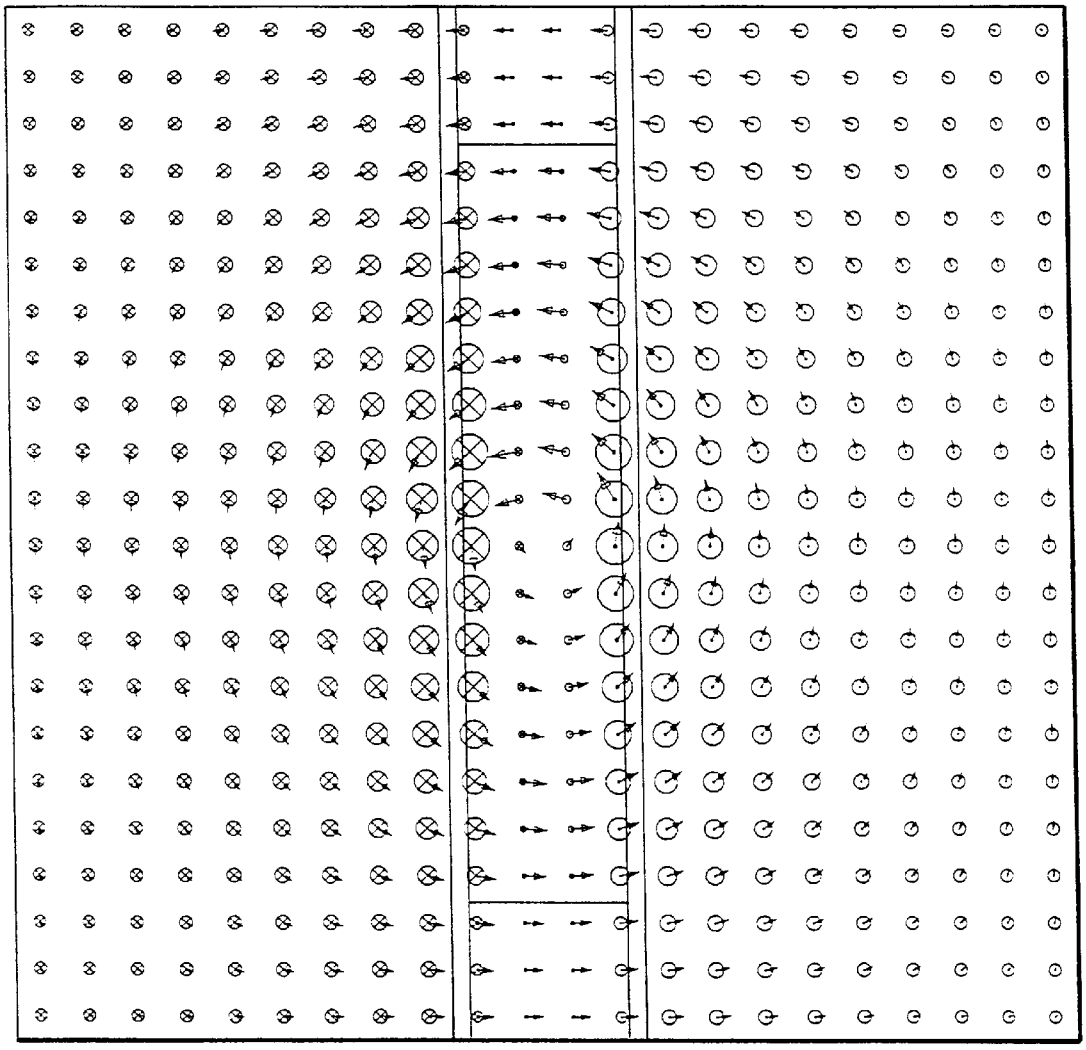
Figure 21:
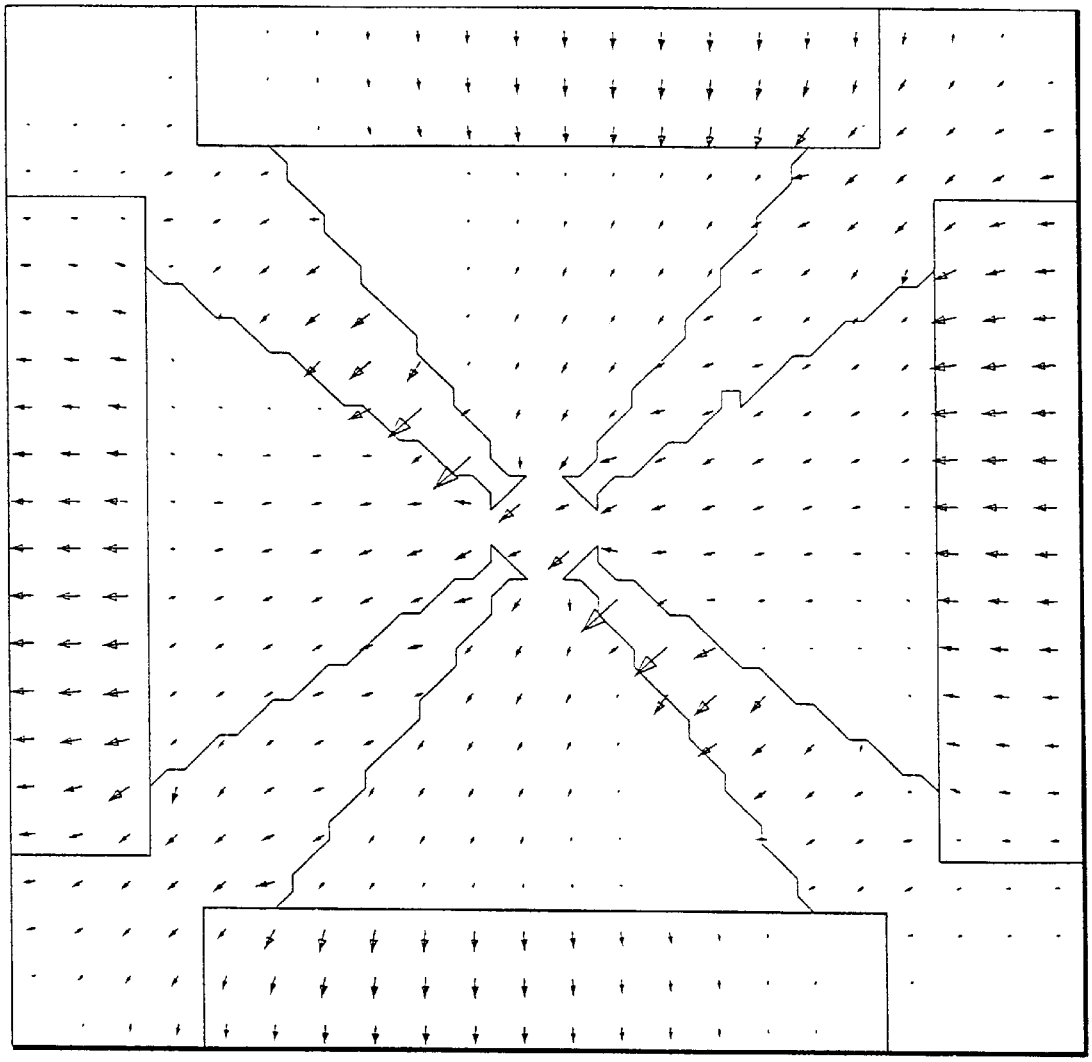
Figure 22:
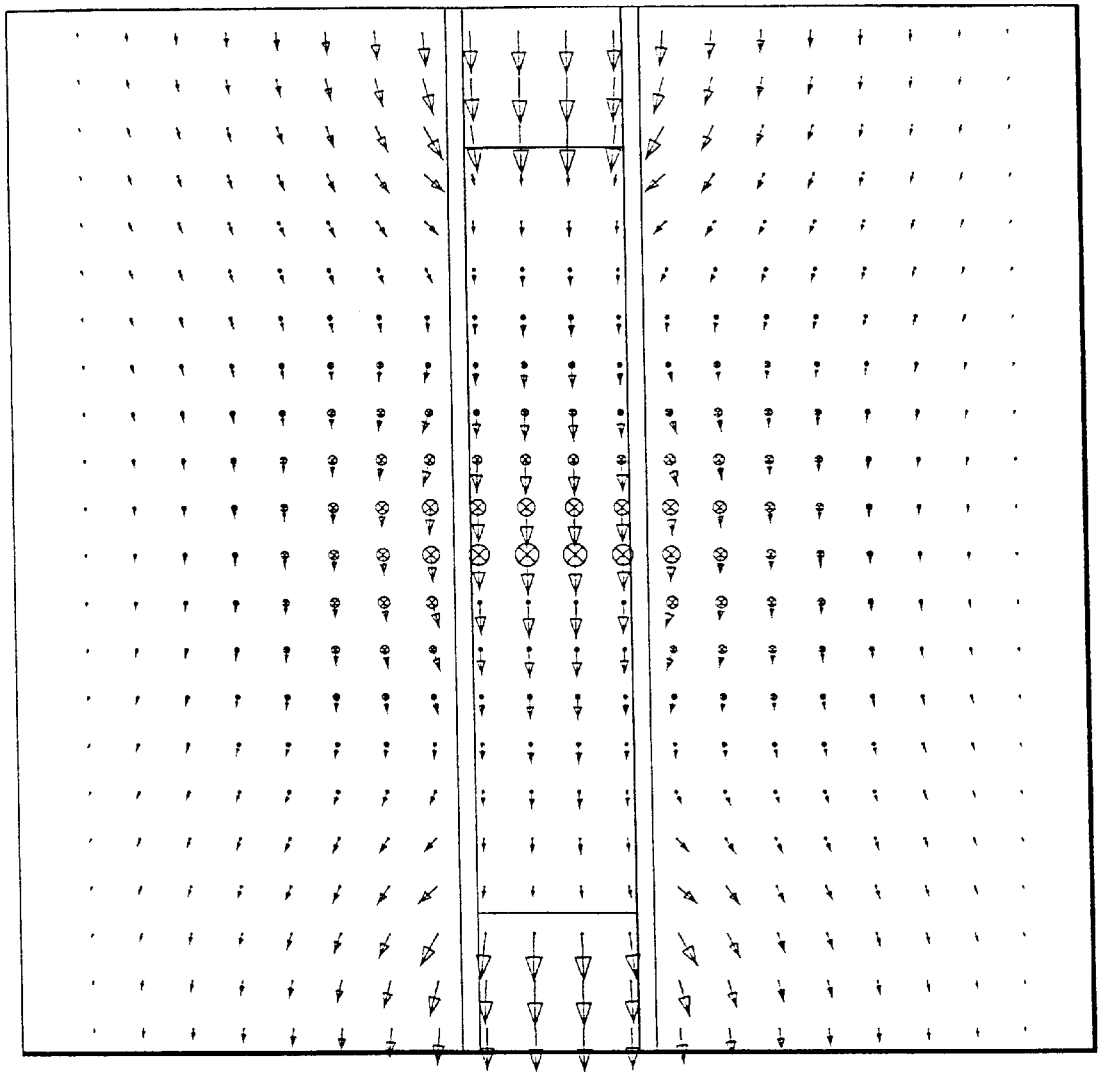
Figure 23:
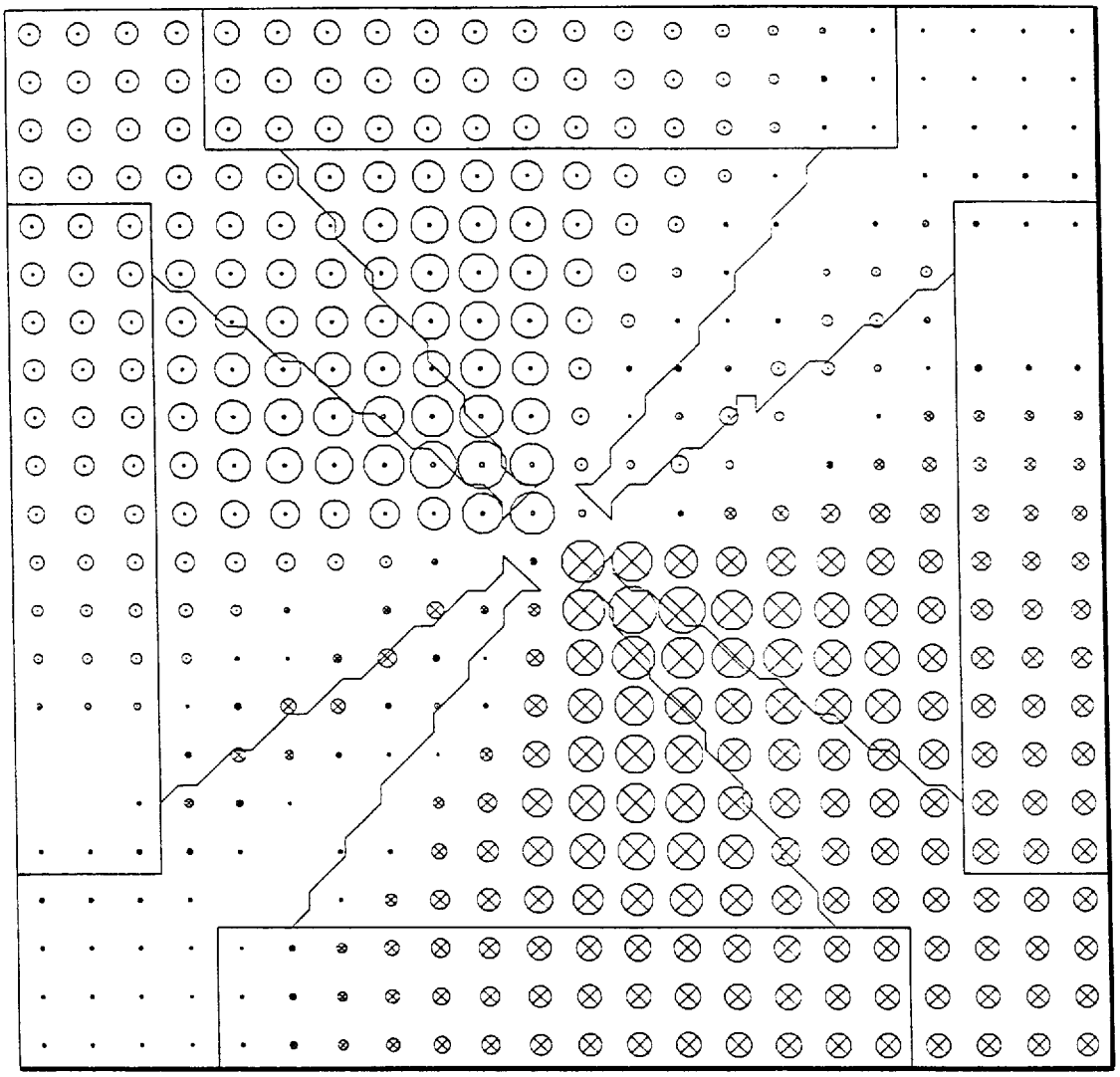
Figure 24:
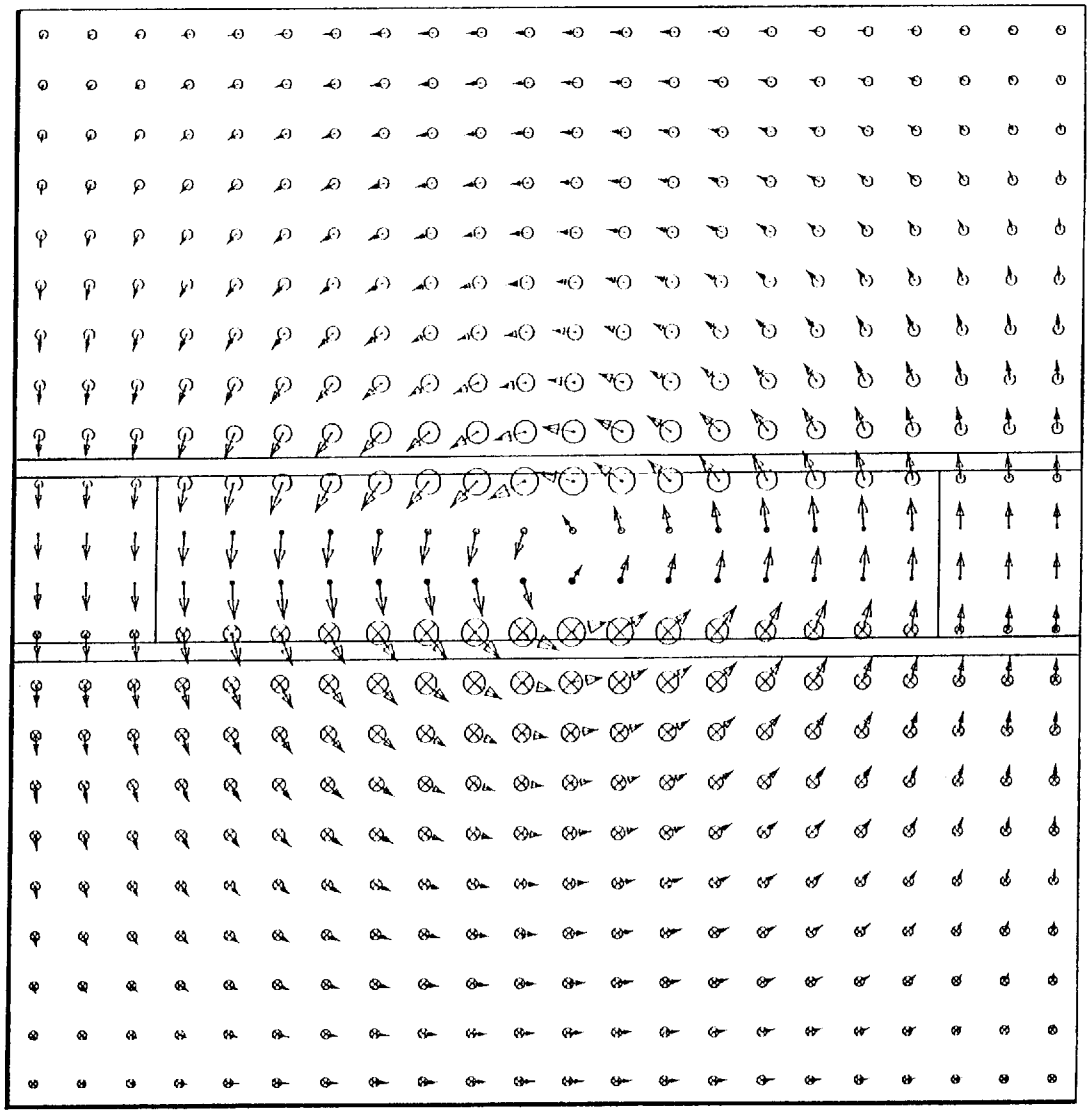

FIG. 16 shows a further embodiment of the invention. The dielectric insert 2 is composed of a disk-shaped structure of the same thickness with rectangular outer contour. The resonator housing 1 is also rectangular. The slots 3 extend from the corners of the rectangular structure in direction toward the disk center and are point-symmetrical in pairs relative to one another. Here also the slots are reduced toward the disk center. Parallelepiped-shaped regions 4 with lower electricity constant are located between the dielectric insert 3 and the resonator housing 1. The electrical fields identified as Ex and the magnetic fields identified as Bx are shown in two planes in FIGS. 17–24. Here x has the values 1 and 2 (dual mode).

In accordance with a further embodiment of the dielectric insert of the present invention, a ball-shaped structure can be selected and provided with slots which extend from the outer surface of the ball in direction toward the ball center.

Both in the embodiment as a plate symmetrical in two planes on a pellet, the slots 3 extend closely to the center of the insert and prevent the base mode, which as a rule is a single mode (depending on the thickness of the plate or pallet) and is used in standard filters. Simultaneously, a dual mode is formed, whose energy is located in the center of the structure. In addition to the embodiments of FIGS. 2, 3 and 16, also such a structure can be used which is an assembly of geometrical standard elements, such as for example a trapezes and a small parallelepepid in the center, or triangles and a pellet or parallelepipid in the center. This is true for circular-cylindrical or ball-shaped structures. The slotted structure provides for a possibility to regulate the mode distance in certain limits by the length and width of the slots. A required coupling of both modes (dual mode operation) can be performed also in the slots, for example by tuning rods or differently wide cuts or by stepping shown in FIG. 16.

In addition to the above mentioned holding possibilities, the embodiments shown in FIG. 16 has the following advantages. In order to suppress a high field intensity (danger of multi-packing) on the one hand and in order to provide a favorable heat conductivity (energy withdrawal from the dielectric in the resonator housing) on the other hand, a compromise is achieved with simultaneously obtaining high qualities. Materials with relatively low losses and low dielectric constants are located as a jaw chuck (parallipipid-shaped region 4) between the housing wall and the dielectric and hold the insert or its part by an outer force (spring, screws and the like).

For obtaining a high quality, the cross-sectional surfaces of all slots together must be smaller than the total cross-sectional surface of the dielectric material. For triple and higher modes, it is favorable to select the resonance frequency of the base mode (for example in cylindrical standard structures TE01-mode) approximately so great as the resonance frequencies of the higher mode.

When the individual segments of the dielectric insert are mounted on the inner walls of the housing, it is advantageous to connect these segments on these walls for increasing the resonator quality by superconductive bridges, for example HTSL elements.

It will be understood that each of the elements described above, or two or more together, may also find a useful application in other types of constructions differing from the types described above.

While the invention has been illustrated and described as embodied in dielectric resonator, and microwave filter provided therewith, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A dielectric resonator, comprising a resonator housing; and at least one dielectric insert located in said resonator housing, said at least one insert having means for providing modes with a same resonance frequency, wherein a sufficiently high modes distance is obtainable, and suppressing a base mode, said means including at least two symmetrical slots which are located opposite to one another and extend radially far relative to a center of said insert for providing modes with a same resonance frequency, wherein a sufficiently high modes distance is obtainable, and suppressing a base mode.

2. A dielectric resonator as defined in claim 1, wherein said dielectric insert is formed as one-piece element provided with said at least two slots.

3. A dielectric resonator as defined in claim 1, wherein said dielectric insert includes a plurality of insert parts which form said slots.

4. A dielectric resonator as defined in claim 1, wherein said dielectric insert is formed as at least one-piece disk-shaped structure having an outer periphery and said center, said slots extending from said outer periphery in direction toward said center.

5. A dielectric resonator as defined in claim 4, wherein said disk-shaped structure has a ring-shaped outer contour.

6. A dielectric resonator as defined in claim 4, wherein said disk-shaped structure has a rectangular outer contour.

7. A dielectric resonator as defined in claim 6, wherein said slots extend from corners of said rectangular outer contour toward said center.

8. A dielectric resonator as defined in claim 1, wherein said dielectric insert is composed of several segments having adjacent surfaces which form said slots therebetween.

9. A dielectric resonator as defined in claim 8, wherein said resonator housing has inner walls, said individual segments being mounted on said inner walls of said resonator housing.

10. A dielectric resonator as defined in claim 8, wherein said dielectric insert has a rectangular contour, said segments having a triangular shape.

11. A dielectric resonator as defined in claim 8, wherein said dielectric insert has a rectangular contour, said segments having a trapezoidal shape.

12. A dielectric resonator as defined in claim 8, wherein said dielectric insert has a circular-cylindrical shape, said segments being formed as circular sectors.

13. A dielectric resonator as defined in claim 8, wherein said dielectric insert has a circular-cylindrical shape, said segments being formed as circular rings.

14. A dielectric resonator as defined in claim 1, wherein said dielectric insert has a central region and outer regions provided with said slots, said central region having a thickness which is greater than a thickness of said outer regions.

15. A dielectric resonator as defined in claim 1, wherein said dielectric insert has a central region formed as a cylinder, and an outer region formed by a plurality of segments located around said cylinder.

16. A dielectric resonator as defined in claim 15, wherein said segments are mounted on said cylinder.

17. A dielectric resonator as defined in claim 1, wherein said slots has a constant cross-section over their extension in a radial direction.

18. A dielectric resonator as defined in claim 1, wherein said slots have a cross-section reducing in direction toward said center.

19. A dielectric resonator as defined in claim 1, wherein said dielectric insert has a central region and an outer region provided with said slots, said central region having a thickness which is selected relative to a thickness of said outer regions so that a high mode is oscillation-susceptible.

20. A dielectric resonator as defined in claim 1, wherein said slots are arranged so that they intersect electrical field lines of a TE01 mode.

21. A dielectric resonator as defined in claim 1, wherein said slots have a depth selected so that a resonance frequency of a TE01 mode is approximately as great as a resonance frequency of higher modes.

22. A dielectric resonator as defined in claim 1, wherein said slots have cross-sectional surfaces which together are smaller than a total cross-sectional surface of a dielectric material of the dielectric resonator.

23. A dielectric resonator as defined in claim 1, wherein said slots are stepped.

24. A microwave filter for multiplexors, having a resonator housing; and at least one dielectric insert located in said resonator housing, said at least one insert having means for providing modes with a same resonance frequency, wherein a sufficiently high modes distance is obtainable, and suppressing a base mode, said means including at least two symmetrical slots which are located opposite to one another and extend radially far relative to a center of said insert for providing modes with a same resonance frequency, wherein a sufficiently high modes distance is obtainable, and suppressing a base mode.

25. A dielectric resonator, comprising a resonator housing; and at least one dielectric insert located in said resonator housing, said at least one insert being formed so that it produces at least two symmetrical slots which are located opposite to one another and extend radially relative to a center of said insert, said dielectric insert having a central region and outer regions provided with said slots, said central region of said dielectric insert having a higher dielectric constant than said outer regions.

* * * * *